US010668757B2

(12) United States Patent
Tomita

(10) Patent No.: US 10,668,757 B2
(45) Date of Patent: Jun. 2, 2020

(54) PRINTER

(71) Applicant: SATO HOLDINGS KABUSHIKI KAISHA, Tokyo (JP)

(72) Inventor: Katsuo Tomita, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/327,429

(22) PCT Filed: Aug. 28, 2017

(86) PCT No.: PCT/JP2017/030684
§ 371 (c)(1),
(2) Date: Feb. 22, 2019

(87) PCT Pub. No.: WO2018/043378
PCT Pub. Date: Aug. 3, 2018

(65) Prior Publication Data

US 2019/0176498 A1 Jun. 13, 2019

(30) Foreign Application Priority Data

Aug. 29, 2016 (JP) ..... 2016-167121

(51) Int. Cl.
*B41J 29/13* (2006.01)
*B65H 23/16* (2006.01)
(Continued)

(52) U.S. Cl.
CPC ..... *B41J 29/13* (2013.01); *B41J 2/32* (2013.01); *B41J 15/042* (2013.01); *B41J 15/046* (2013.01);
(Continued)

(58) Field of Classification Search
CPC ... B41J 29/13; B41J 2/32; B41J 15/042; B41J 15/046; B41J 15/16; B41J 29/02; B65H 23/16
See application file for complete search history.

(56) References Cited

U.S. PATENT DOCUMENTS

2011/0193927 A1 8/2011 Matsushima et al.
2018/0167530 A1* 6/2018 Matsuda ..... B41J 2/355

FOREIGN PATENT DOCUMENTS

CN 204605202 9/2015
CN 105774269 A 7/2016
(Continued)

OTHER PUBLICATIONS

Chinese Office Action and English translation, Chinese Application CN 201780039555, dated Apr. 26, 2009 17 pages.
(Continued)

*Primary Examiner* — Lamson D Nguyen
(74) *Attorney, Agent, or Firm* — Foley & Lardner LLP

(57) ABSTRACT

A printer according to one embodiment includes: a container configured to store a roll, the roll being a belt-like shaped print medium that is wound; a limiter in the container, the limiter having an abutting face to limit movement of the roll stored in the container and the belt-like shaped print medium extracted from the roll in width directions; and a damper disposed at a position opposed to a surface of the print medium extracted from the roll and the abutting face, the damper absorbing fluctuations in tension of the print medium.

13 Claims, 11 Drawing Sheets

(51) Int. Cl.

| | |
|---|---|
| ***B41J 15/04*** | (2006.01) |
| ***B41J 15/16*** | (2006.01) |
| ***B41J 2/32*** | (2006.01) |
| ***B41J 29/02*** | (2006.01) |

(52) U.S. Cl.
CPC ..... *B41J 15/16* (2013.01); *B41J 29/02* (2013.01); *B65H 23/16* (2013.01)

(56) References Cited

FOREIGN PATENT DOCUMENTS

| | | | |
|---|---|---|---|
| JP | 56-63538 | U1 | 5/1981 |
| JP | 04-260564 | A | 9/1992 |
| JP | 04-361075 | A | 12/1992 |
| JP | 7-97114 | A | 4/1995 |
| JP | 2000-52613 | A | 2/2000 |
| JP | 2007-031077 | A | 2/2007 |
| JP | 2011-183608 | A | 9/2011 |
| JP | 2012-187911 | A | 10/2012 |
| JP | 2015-208978 | A | 11/2015 |

OTHER PUBLICATIONS

Extended European Search Report, Application No. 17846383.2, dated Jul. 3, 2019, 10 pages.

* cited by examiner

PRINTER

TECHNICAL FIELD

The present invention relates to printers configured to extract a belt-like print medium, such as a continuous sheet, from a roll and to print data on the print medium.

BACKGROUND

Conventionally a printer configured to store a roll, such as a roll of paper being a wound continuous sheet, has been known. The printer extracts such a continuous sheet and prints information on the continuous sheet. A continuous sheet for such a printer may include a liner and a plurality of labels on the liner, and the printer may print information on each label.

Some of such conventional printers include a damper to absorb fluctuations in tension of the continuous sheet extracted from the roll of paper. For instance, Patent Literature 1 describes a printer including a biasing roller (e.g., biasing roller 12 in FIG. 2 of Patent Literature 1) as one example of the damper, and the biasing roller is to bias (press) a part of a continuous sheet between a feed roller and the roll to suppress the loosing of the continuous sheet at this part.

CITATION LIST

Patent Literature

Patent Literature 1: JP 2011-183608A

SUMMARY OF THE INVENTION

Technical Problem

If impact is given to a continuous sheet during feeding of the sheet, movement of the continuous sheet is preferably avoided in the width direction of the continuous sheet extracted from the roll of paper (i.e., in the direction perpendicular to the direction from the roll of paper to the print head). To this end, a guide member to limit the movement of a continuous sheet in such a direction may be provided at the damper or such a guide member may be separately from the damper. This, however, increases in the size of the printer or in the number of the components of the printer.

The present disclosure aims to provide a printer including a damper to absorb fluctuations in tension of a continuous sheet extracted from a roll of paper, and the printer avoids the movement of the continuous sheet in the width direction without increasing the size or the number of components of the printer.

Solution to Problem

Advantageous Effects

According to one aspect of the present invention, a printer includes a damper to absorb fluctuations in tension of a continuous sheet extracted from a roll of paper, and the printer avoids the movement of the continuous sheet in the width direction without increasing the size or the number of components of the printer.

DESCRIPTION OF EMBODIMENTS

The following describes one embodiment of a printer according to the present invention.

(1) Structure of Printer

Figure 1:
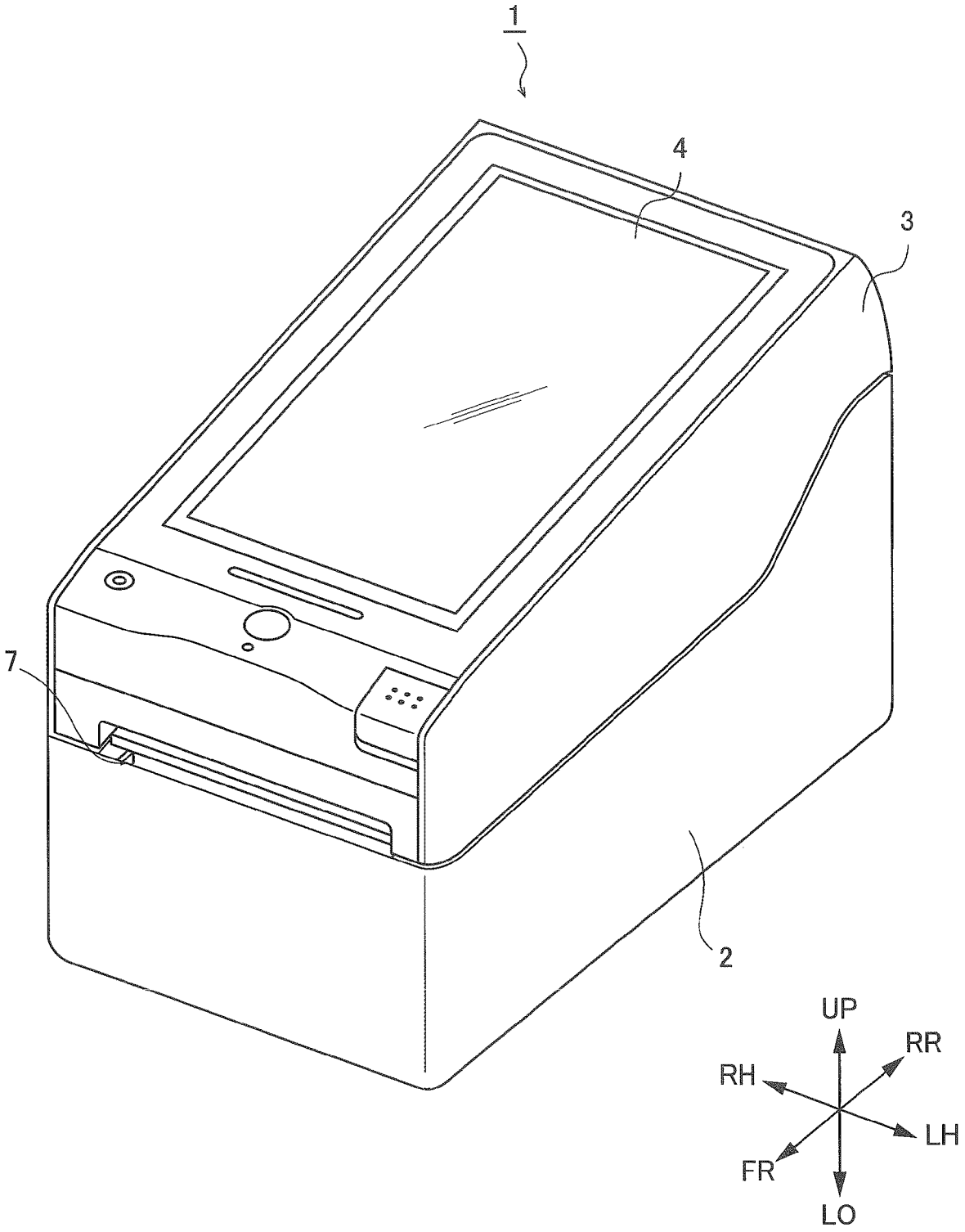
FIG. 1 is a perspective view of a printer according to one embodiment when the cover is closed.
Figure 2:
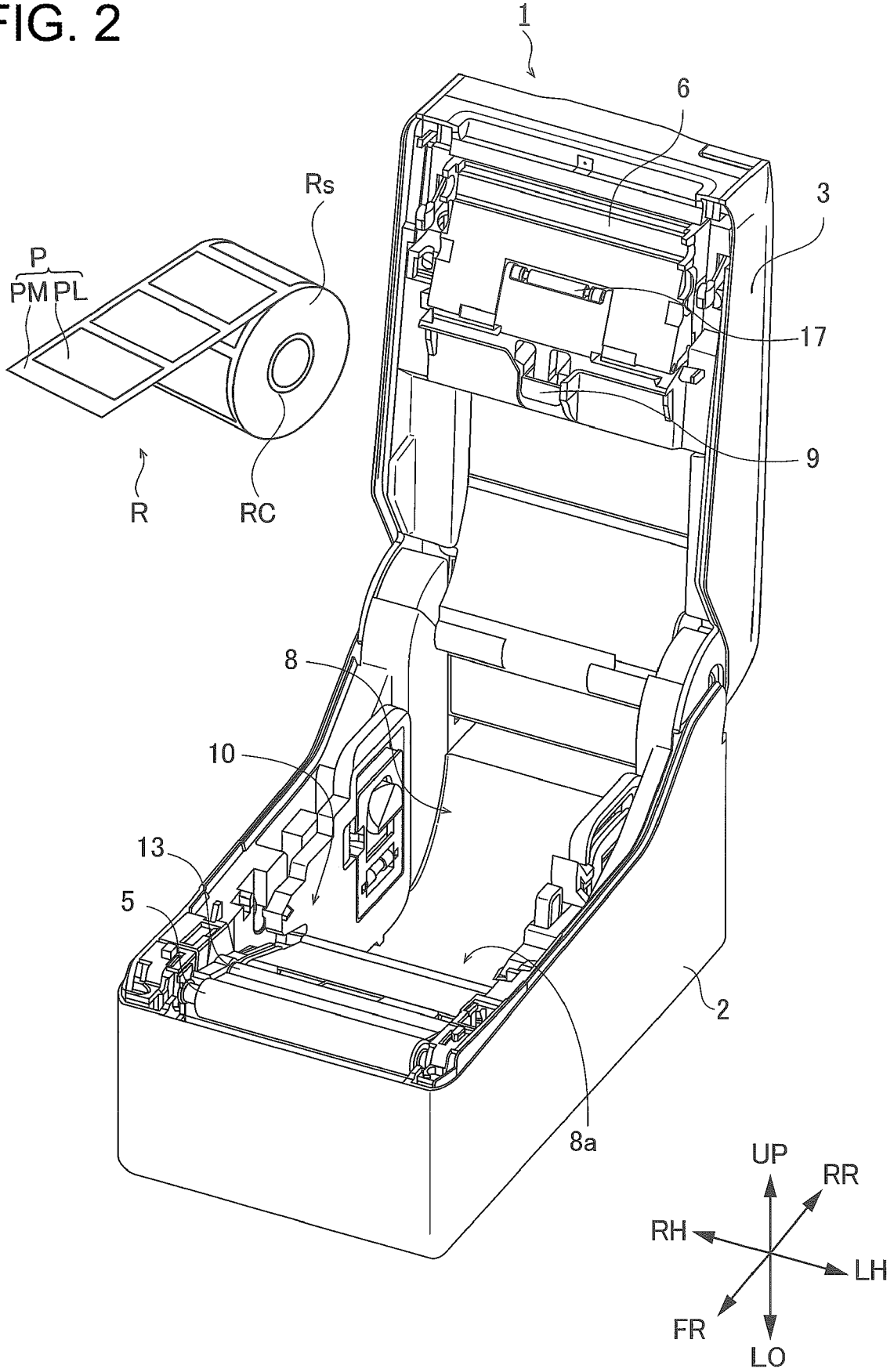
FIG. 2 is a perspective view of a printer according to one embodiment when the cover is open.
Figure 3:
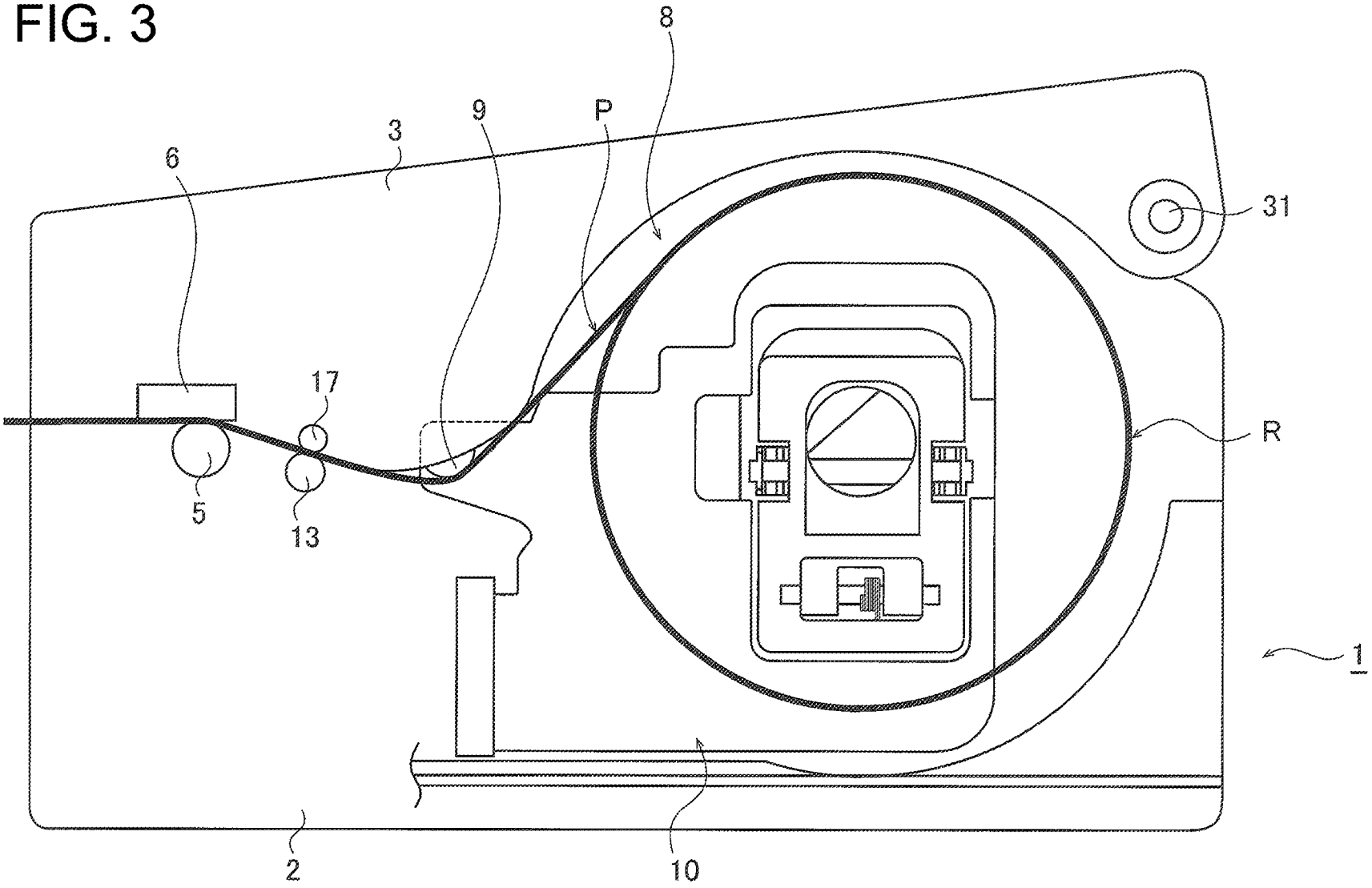
FIG. 3 is a schematic cross-sectional view of a printer according to one embodiment to explain the operation of the printer.

Referring to FIGS. 1 to 3, the following describes a printer according to a first embodiment.

FIG. 1 is a perspective view of a printer 1 according to the present embodiment when a cover 3 is closed. FIG. 2 is a perspective view of the printer 1 according to the present embodiment when the cover 3 is open. FIG. 3 is a schematic cross-sectional view of the printer 1 according to the present embodiment to explain the operation of the printer 1.

As shown in FIGS. 1 and 2, the printer 1 of the present embodiment includes a housing 2, the cover 3, a display panel 4, a platen roller 5, a thermal head 6, a container 8, a damper 9, a guide mechanism 10 and assisting rollers 13, 17. The housing 2 is shaped to match the outer shape of the printer 1.

As described in FIG. 1, the printer 1 has a substantially rectangular bottom face, and the direction along the long side of the bottom face is defined as the front-rear direction. Specifically, a side of the printer having the platen roller 5 that is placed downstream in the feeding direction is defined as the front (FR), and a side of the printer on the opposite side and upstream in the feeding direction is defined as the rear (RR). Then the right (RH), the left (LH), the upper (UP) and the lower (LO) are defined relative to the front-rear direction. In the following description, the right (RH) or the left (LH) direction may be called a transverse direction and the upper (UP) or the lower (LO) direction may be called a vertical direction.

The container 8 is an internal space of the housing 2 to store a roll of paper R. The space is defined with the inner bottom face 8*a* (see FIG. 2) of the housing at the bottom, the inner face of the cover 3 at the top, and the inner side faces of the housing on the left and right. The cover 3 is to open or close the container 8. The cover 3 is supported swingably at the rear end of the housing 2 via a shaft 31 (see FIG. 3).

As shown in FIG. 2, a roll of paper R (one example of a roll) includes a belt-like continuous sheet P (one example of a print medium) wound around a paper core RC as a roll. In the illustrated example, the continuous sheet P includes a belt-like liner PM and a plurality of labels PL. These labels are temporally attached on the liner at predetermined intervals. The paper core RC has a hollow cylindrical shape.

The printer 1 of the present embodiment extracts a continuous sheet P from the roll of paper R while rotating the platen roller 5, and the container 8 includes a space to define the feed path of the extracted continuous sheet P from the roll of paper R to the platen roller 5.

The container 8 includes the guide mechanism 10. The guide mechanism 10 holds the roll of paper R rotatably in the container 8 and limits the movement of the roll of paper R in the width direction. The guide mechanism 10 of the present embodiment incorporates a motion mechanism 20 (described later) so as to deal with a variety of rolls of paper having different widths.

The damper 9 is opposed to the surface (specifically a print surface) of the continuous sheet P extracted from the roll of paper R and to limiters 12L, 12R (described later) of the guide mechanism 10. The damper absorbs fluctuations in tension of the continuous sheet P. The damper 9 is attached to the cover 3. As shown in FIG. 3, the damper 9 is positioned so as to be opposed to the face of the continuous sheet P extracted from the roll of paper R when the cover 3 is closed.

As shown in FIG. 1, the cover 3 includes the display panel 4 on the surface. The display panel 4 provides an input/output interface to a user when the cover 3 is closed. The display panel is a liquid crystal panel having a touch-panel function, for example.

As shown in FIG. 2, the platen roller 5 is supported rotatably in the forward and reverse directions at a downstream part of the housing 2 in the feeding direction. The platen roller 5 is a feeding means to feed the continuous sheet P extracted from the roll of paper R. The platen roller extends in the width direction of the continuous sheet P. The platen roller 5 is mechanically coupled to a stepping motor (not illustrated) or the like for driving.

The assisting roller 13 is disposed at the side of the housing 2, and the assisting roller 17 is disposed at the side of the cover 3. As shown in FIG. 3, when the cover 3 is closed, the assisting rollers 13, 17 are opposed while sandwiching the continuous sheet P therebetween to assist the feeding of the continuous sheet P toward the platen roller 5.

The thermal head 6 is mounted at the cover 3 so as to be opposed to the platen roller 5 when the cover 3 is closed.

The thermal head 6 is a print means to print information, such as letters, symbols, graphics or barcodes, on a label PL of the continuous sheet P extracted from the roll of paper R. As shown in FIG. 3, when the cover 3 is closed, the printing face of the thermal head 6 faces the sheet-feeding route of the continuous sheet P and the thermal head 6 is opposed to the platen roller 5. On the printing face of the thermal head 6, a plurality of heater resistors (heater elements) that generate heat when applying current are arranged along the width direction of the continuous sheet P. The thermal head 6 is connected to a circuit board (not illustrated) to transmit a print signal to the thermal head 6.

Although not illustrated, a coil spring as a biasing member is mounted on the rear face of the thermal head 6. This coil spring gives a biasing force to the thermal head 6.

When the cover 3 is closed for printing, the continuous sheet P extracted from the roll of paper R is fed by the platen roller 5 while being sandwiched between the platen roller 5 and the thermal head 6. At this time, the thermal head 6 is pressed against the platen roller 5 by the biasing force, whereby pressure from the head suitable for printing can be generated.

As shown in FIG. 3, when the cover 3 is closed and the platen roller 5 is driven in the forward direction, the continuous sheet P extracted from the roll of paper R held by the guide mechanism 10 moves toward the platen roller 5 while being sandwiched between the assisting rollers 13, 17. The damper 9 between the assisting rollers 13, 17 and the container 8 operates to absorb fluctuations in tension of the continuous sheet P extracted from the roll of paper R. After printing on the continuous sheet P by the thermal head 6 opposed to the platen roller 5, the printer ejects the continuous sheet P to the outside of the printer 1 through an ejection port 7 that is a gap defined between the housing 2 and the cover 3 when the cover 3 is closed.

(2) Structure of Guide Mechanism 10

Referring next to FIGS. 4 to 7, the following describes the structure of the guide mechanism 10.

Figure 4:
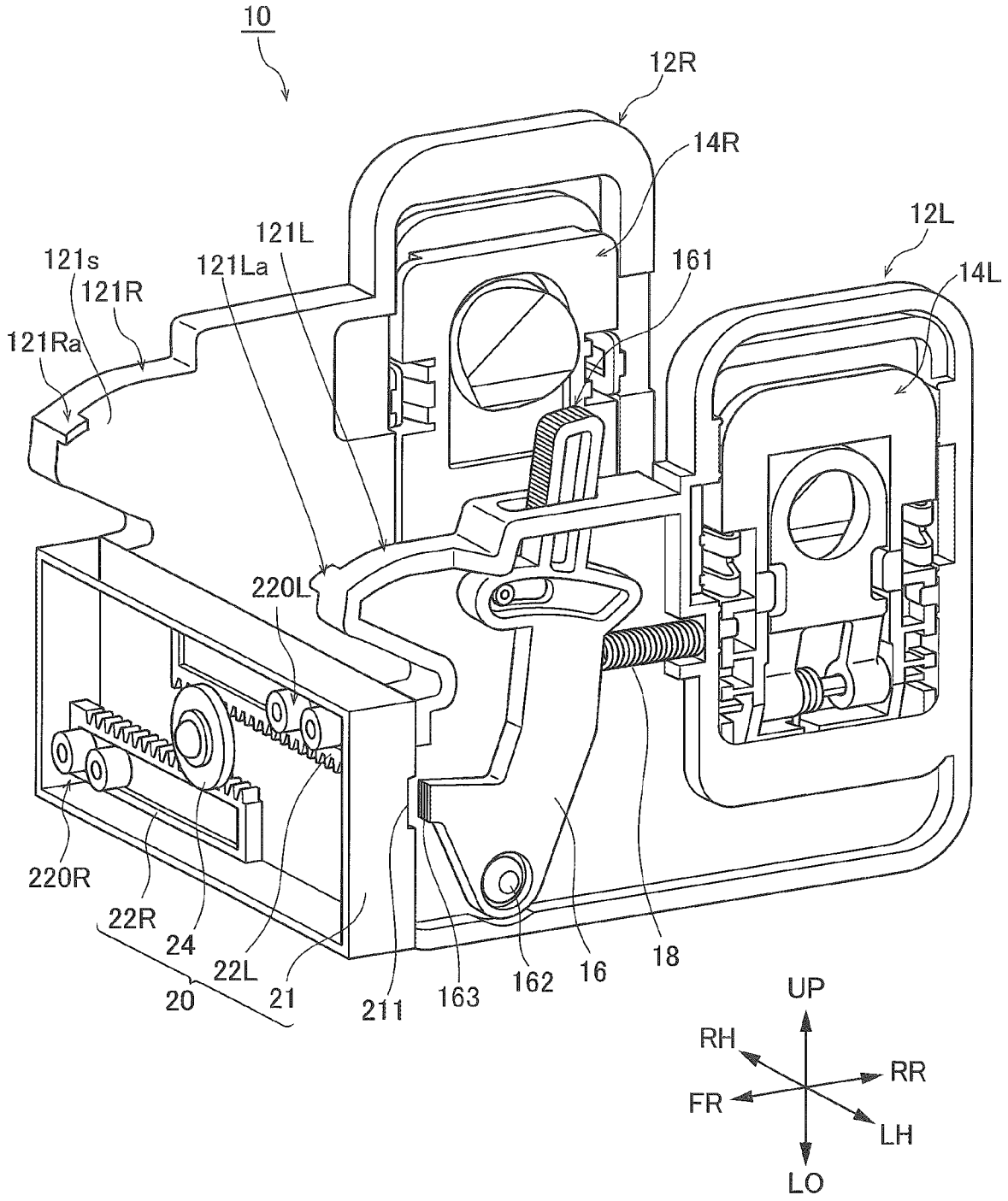
FIG. 4 is a perspective view of a guide mechanism of a printer according to one embodiment.

FIG. 4 is a perspective view of the guide mechanism 10 according to the present embodiment.

Figures 5A, 5B:
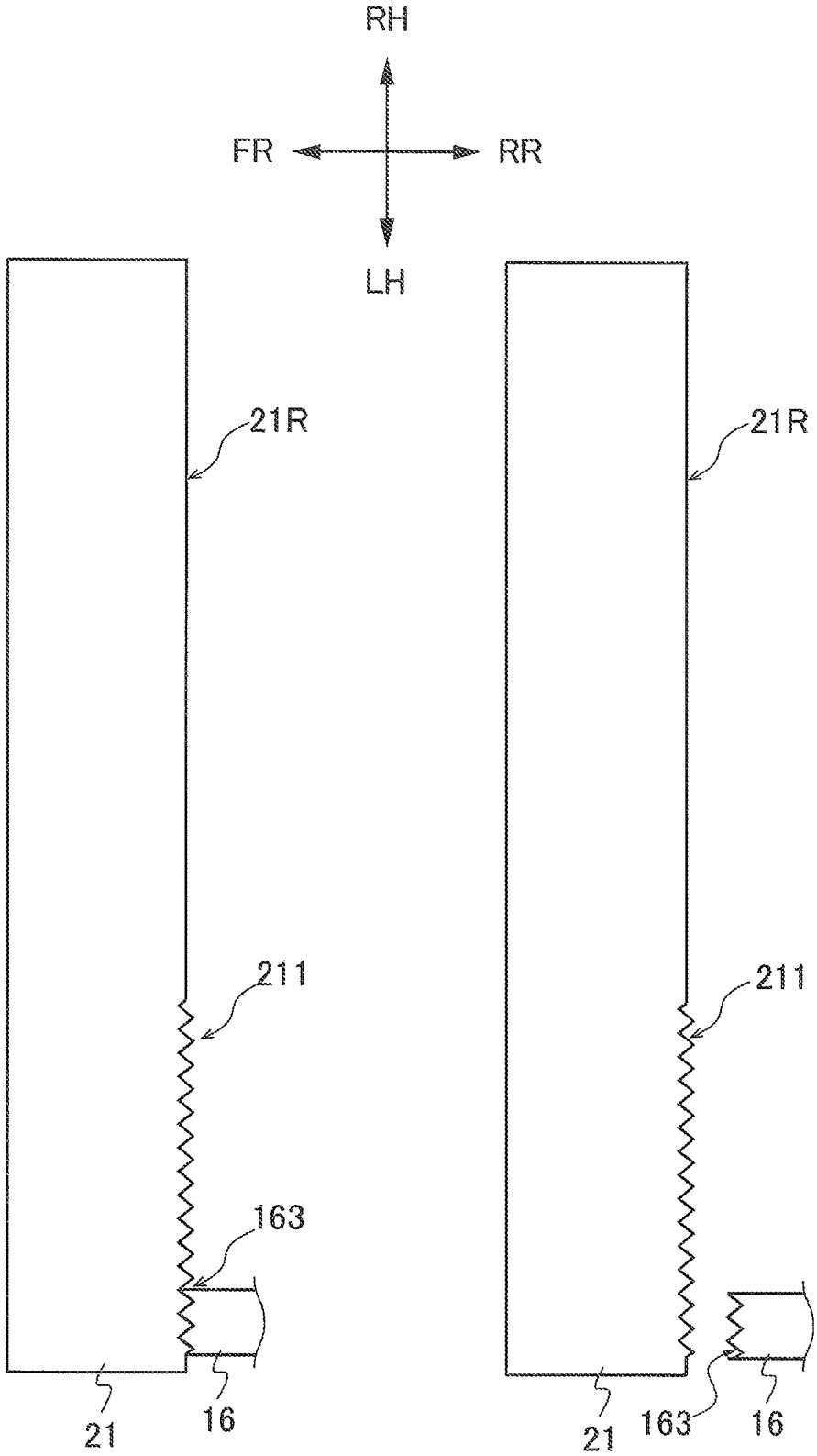
FIG. 5A is a plan view of a motion mechanism of a printer according to one embodiment, showing the housing of the motion mechanism engaging with the lock member.
FIG. 5B is a plan view of a motion mechanism of a printer according to one embodiment, showing the housing of the motion mechanism not engaging with the lock member.
Figure 6:
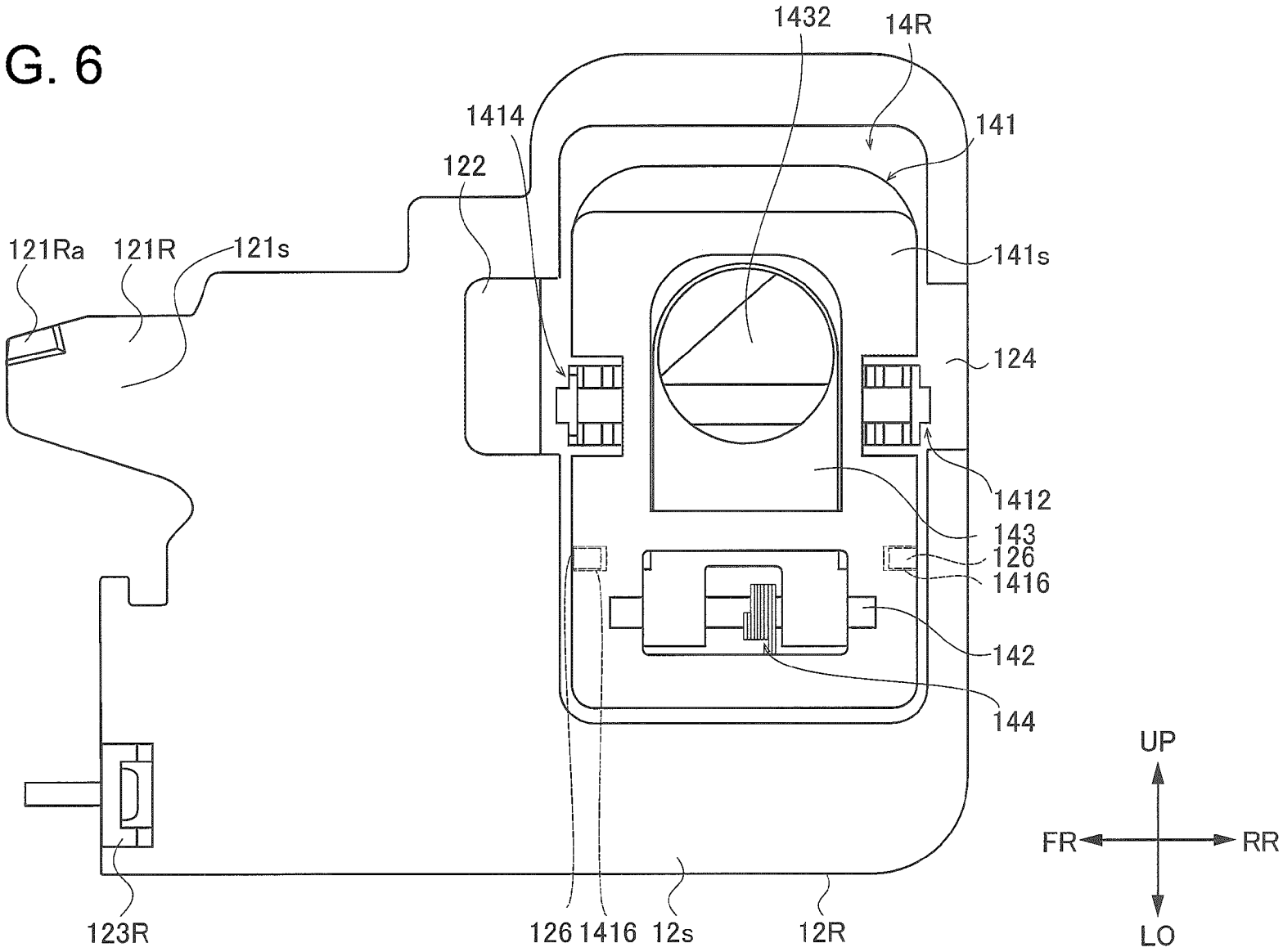
FIG. 6 is a side view of a part of a guide mechanism of a printer according to one embodiment.
Figure 7:
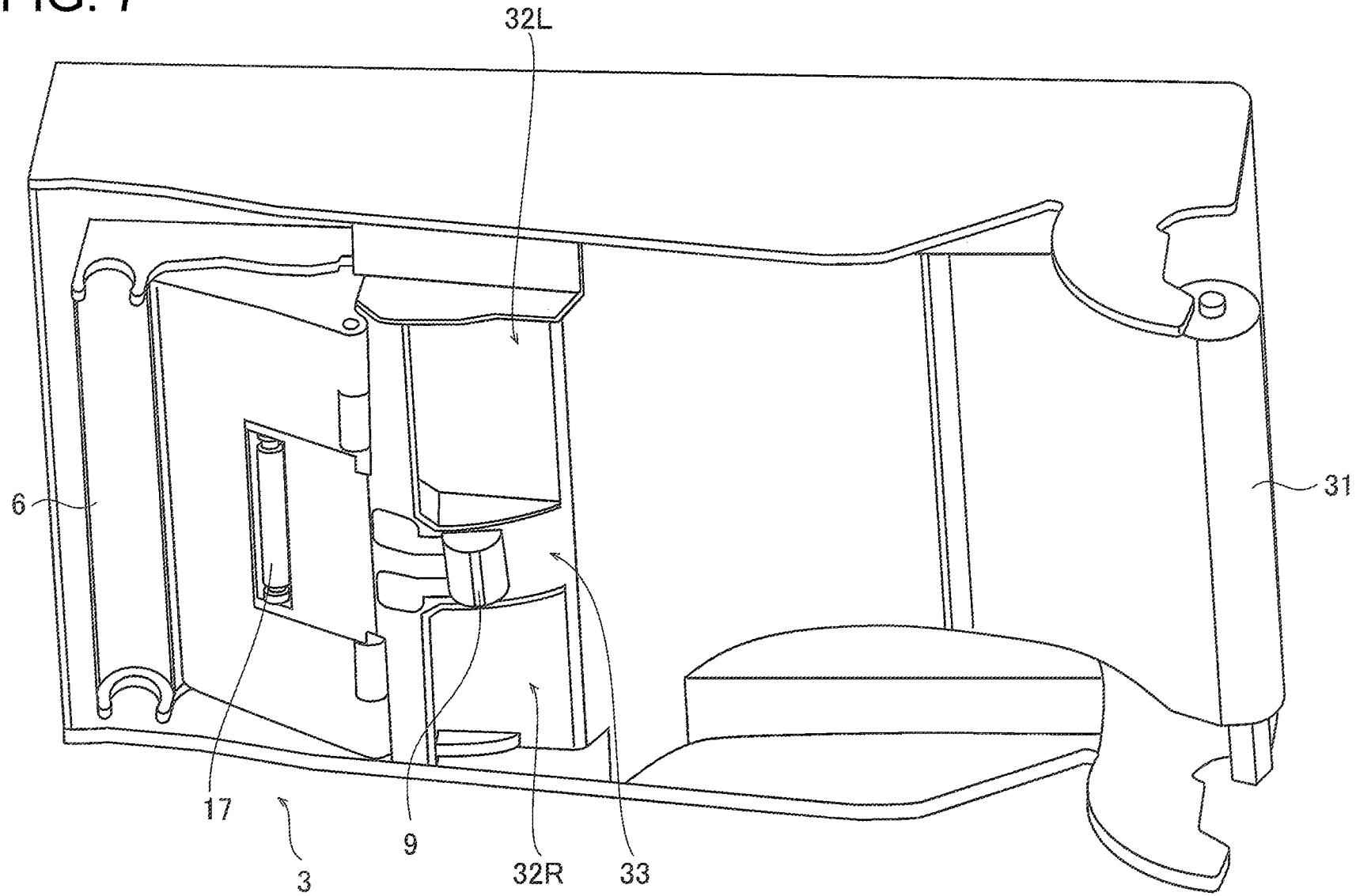
FIG. 7 is a perspective view of a cover of a printer according to one embodiment.

FIG. 5A is a plan view of the motion mechanism 20 in the guide mechanism 10 according to the present embodiment, showing the housing of the motion mechanism engaging with a lock member. FIG. 5B is a plan view of the motion mechanism 20 in the guide mechanism 10 according to the present embodiment, showing the housing of the motion mechanism not engaging with the lock member. FIG. 6 is a right side view of the guide mechanism 10 according to the present embodiment. FIG. 7 is a perspective view of the cover 3 of the printer 1 according to the present embodiment.

Referring to FIG. 4, the guide mechanism 10 includes a pair of limiters 12L, 12R and a pair of roll holders 14L, 14R. As described later, the roll holders 14L and 14R engage with the limiters 12L and 12R, respectively.

The limiters 12L, 12R are plate-like members extending in the front-rear direction of the printer 1. Each of the limiters has an abutting face 12*s* (see FIG. 6) to abut on the side face Rs of the roll of paper R and an abutting face 121*s* to abut on the continuous sheet P drawn from the roll of paper toward the downstream of the feeding direction. The limiters are configured to limit the movement of the roll of paper R and the continuous sheet P in their width directions. The roll holders 14L, 14R are provided to hold the roll of paper R in the container 8.

The guide mechanism 10 of the present embodiment incorporates the motion mechanism 20. The motion mechanism allows the limiters 12L and 12R to move toward each other or move away from each other (i.e., in the transverse direction or in the width direction of the roll of paper R stored in the container 8). In other words, the motion mechanism 20 can adjust the positions of the limiters 12L, 12R in the transverse direction in accordance with the width of the roll of paper R.

The motion mechanism 20 includes a pair of racks 22L, 22R and a pinion 24 in a housing 21. The limiter 12L and the rack 22L are coupled via a fastener 220L from the rear face of the housing 21 so that the limiter 12L and the rack 22L can move together in the transverse direction. The limiter 12R and the rack 22R are coupled via a fastener 220R from the rear face of the housing 21 so that the limiter 12R and the rack 22R can move together in the transverse direction.

That is, the limiters 12L and 12R can move toward each other or move away from each other.

The lock member 16 is a member to limit the motion of the limiters 12L, 12R in the transverse direction or to cancel the limiting in response to the user's manipulation. The lock member 16 includes a tab 161 to be manipulated by a user, a shaft 162, and an engaging part 163 to engage with the rear face of the housing 21. The lock member 16 is mounted on the limiter 12L at the shaft 162 so as to be swingable about the shaft 162.

FIG. 3 shows the limiters 12L, 12R when they are not limited in the movement in the transverse direction.

FIG. 5A shows the housing 21 of the motion mechanism 20 engaging with the lock member 16. In the example of FIG. 5A, the engagement part 163 of the lock member 16 has continuous V-shaped (or serrated) grooves. The housing 21 of the motion mechanism 20 has a rear face 21R. The rear face has continuous V-shaped (or serrated) grooves similar to those of the engagement part 163 at the position opposed to the engagement part 163. As shown in FIG. 4, a coil spring 18 mounted biases the lock member 16 counterclockwise when viewing the printer 1 in a side view from the left to the right. With this configuration, when the user does not manipulate the tab 161, the engagement part 163 of the lock member 16 and the engagement part 211 of the housing 21 engage as shown in FIG. 5A to limit the movement of the limiters 12L, 12R in the transverse direction.

FIG. 5B shows the housing 21 of the motion mechanism 20 not engaging with the lock member 16 (the same state as in FIG. 4). To cancel the engagement of the housing 21 with the lock member 16 in FIG. 5A, a user moves the tab 161 of the lock member 16 rearward against the biasing force of the coil spring 18. Then, the lock member 16 rotates clockwise in a side view from the left to the right of the printer 1 to cancel the engagement between the engagement part 163 of the lock member 16 and the engagement part 211 of the housing 21. When the tab 161 is moved rearward, the rack-and-pinion mechanism of the motion mechanism 20 can function, so that the motion of the limiters 12L, 12R in the transverse direction is not limited. The limiters 12L and 12R in such a state can move toward each other or move away from each other. Then a user can adjust the limiters 12L and 12R to any desired positions in the width direction of the roll of paper R in accordance with the width of the roll of paper R to be stored in the container 8.

After setting the limiters 12L, 12R at a desired position, the user stops the manipulation of the tab 161. Then the engagement part 163 of the lock member 16 and the engagement part 211 of the housing 21 engage again due to the biasing force of the coil spring 18 to limit the movement of the limiter 12L in the transverse direction.

Referring next to FIG. 6, the following describes the limiters 12L, 12R and the roll holders 14L, 14R. FIG. 6 shows a part of the guide mechanism 10 on the right, i.e., the limiter 12R and the roll holder 14R. A part of the guide mechanism on the left (limiter 12L and roll holder 14L) has a similar shape.

Referring to FIG. 6, the roll holder 14R includes a plate-like body 141, a shaft 142, a swing member 143 and a torsion spring 144. The plate-like body 141 has a rectangular shape as a whole.

The roll holder 14R is attached to the limiter 12R.

More specifically the plate-like body 141 includes attachments 1412 and 1414, and each of the attachments has a claw on the surface and the rear face of FIG. 6. These claws engage with thin-wall parts 122, 124 of the limiter 12R. The limiter 12R has convexes 126 on the front and the rear and the plate-like body 141 has concaves 1416 on the front and the rear, and these convexes and concaves engage at two positions. Each concave 1416 has a U-shape in cross section having an opening. The opening of the concave 1416 receives the corresponding convex 126 for insertion for engagement of the concave 1416 and the convex 126.

In the roll holder 14R, the plate-like body 141 supports the shaft 142 rotatably, and the swing member 143 is coupled to the shaft 142. With this configuration, the swing member 143 can swing about the shaft 142. The swing member 143 has a holding part 1432 that protrudes toward the center in the left- and right direction. As the swing member 143 swings, the holding part 1432 can swing between a protruding position where the holding part protrudes from the abutting face 12*s* of the limiter 12R and a non-protruding position where the holding part does not protrude from the abutting face 12*s*. The holding part 1432 at the protruding position holds the roll of paper R rotatably.

The torsion spring 144 biases the holding part 1432 of the swing member 143 in the direction from the non-protruding position to the protruding position. When the roll of paper R is inserted into the container 8, the holding part 1432 operates as follows.

When the user inserts the roll of paper R into the container 8, the outer circumferential face and the side faces Rs of the roll of paper R firstly come into contact with the holding part 1432. This makes the holding part 1432 swing to the non-protruding position where the holding part does not protrude inwardly from the abutting face 12*s* against the biasing force of the torsion spring 144, and so the outer circumferential face of the roll of paper R is allowed to pass through the holding part 1432.

When the roll of paper R moves further downward until the hollow part of the paper core RC of the roll of paper R reaches the same height as the holding part 1432, the holding part 1432 swings inwardly due to the biasing force of the torsion spring 144. That is, at the hollow part of the paper core RC of the roll of paper R, the holding part 1432 swings to the protruding position where the holding part protrudes inwardly from the abutting face 12*s* of the limiter 12R. As a result, the roll holder 14R holds the roll of paper R.

Similarly to the abutting face 12*s* of the limiter 12R, the surface 141*s* of the plate-like body 141 also faces the side face Rs of the roll of paper R. Preferably the abutting face 12*s* of the limiter 12R and the surface 141*s* of the plate-like body 141 are in the same plane. When they are in the same plane, the roll holder can hold the roll of paper R efficiently from the initial stage of the roll of paper R stored having a larger outer diameter to the final stage of the roll of paper R having a smaller outer diameter.

Referring to FIG. 6, the limiter 12R has a sheet guide 121R, and the sheet guide extends in the extracting direction of the continuous sheet P from the roll of paper R. As shown in FIG. 4, the limiter 12L also has a sheet guide 121L, and this sheet guide part extends in the extracting direction of the continuous sheet P from the roll of paper R held at the holding part 1432. The inner face of the sheet guide 121L, 121R defines the abutting face 121*s*.

Referring to FIG. 7, the cover 3 is formed so as to provide regions 32L, 32R on the inner face (face opposed to the container) and on the outside of the damper 9 in the width direction of the roll of paper R stored in the container 8. These regions 32L, 32R are to allow the sheet guides 121L, 121R of the limiters 12L, 12R to move in the transverse direction. Since these sheet guides 121L, 121R are provided on both of the left and right sides of the damper 9, the surface of the continuous sheet P extracted from the roll of paper R comes into contact with the damper 9 and both ends of the continuous sheet P in the width direction are guided by the sheet guides 121L and 121R.

As shown in FIGS. 2 and 7, the damper 9 is mounted at a center position between the limiters 12L and 12R in the moving direction of the limiters 12L and 12R. The damper 9 has a width in the transverse direction that is smaller than the width of the continuous sheet P. Such a compact damper is excellent in space-saving.

As shown in FIG. 6, the sheet guide 121R has a protrusion 121Ra at the front end that is a piece protruding inwardly (the direction where the limiters 12L and 12R face). As shown in FIG. 4, the sheet guide 121L also has a protrusion 121La at the front end that is a piece protruding inwardly. These protrusions 121La and 121Ra function as a flutter prevention part configured to prevent the continuous sheet P from fluttering in the direction of the faces of the sheet that is drawn from the roll of paper R to the downstream in the feeding direction.

FIG. 6 shows the attachment 123R to be attached to the housing 21 (not illustrated in FIG. 6) to couple with the rack 22R of the motion mechanism 20.

(3) Structure and Operation of Damper 9

Referring next to FIGS. 8 to 11, the following describes the structure and operation of the damper 9.

Figure 8A:
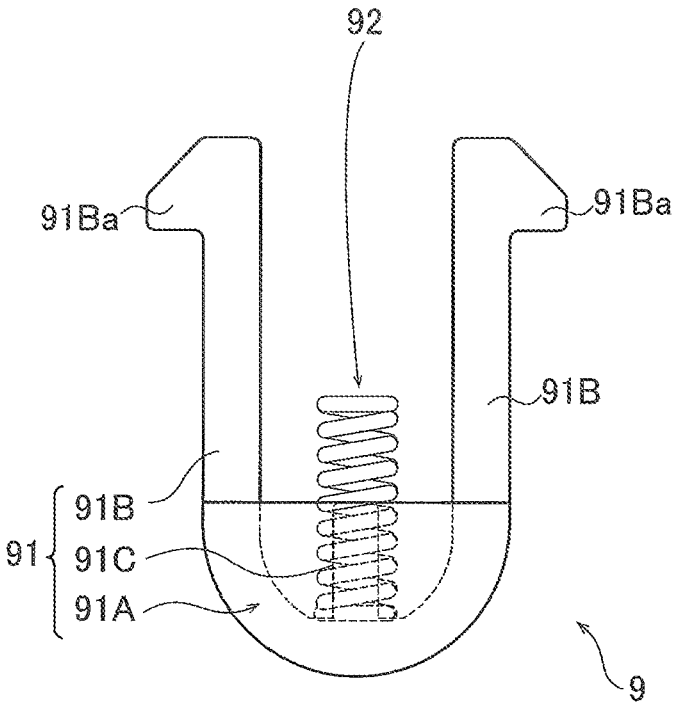
FIG. 8A is a front view of a damper according to one embodiment.
Figure 8B:
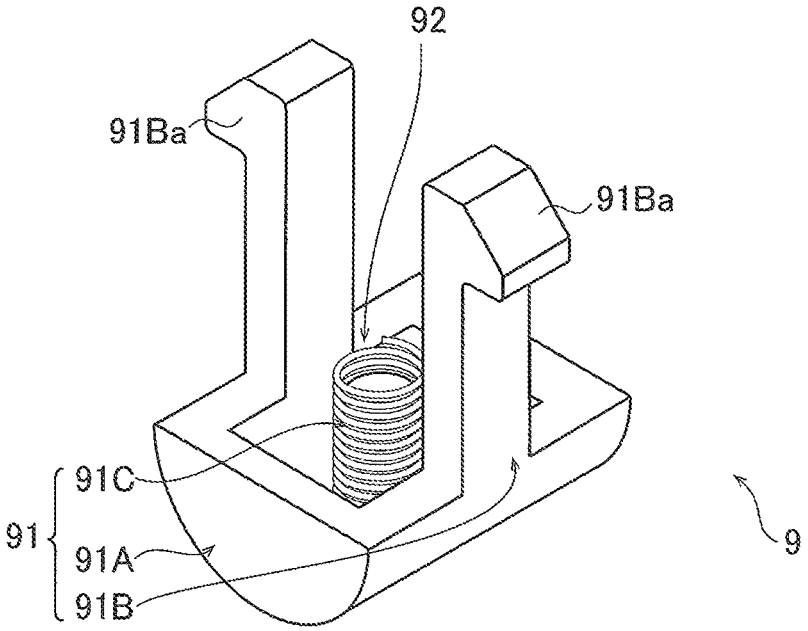
FIG. 8B is a perspective view of a damper according to one embodiment.
Figure 9:
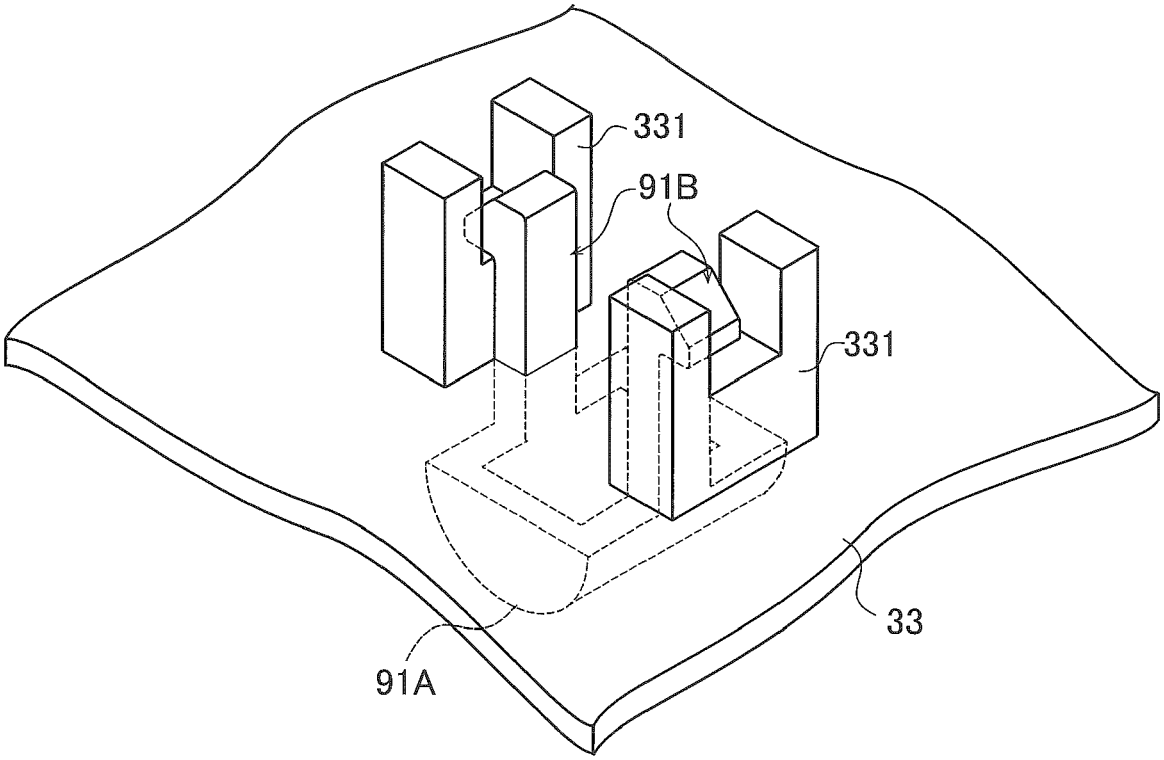
FIG. 9 is a perspective view schematically showing the attaching of a damper according to one embodiment.
Figure 10:
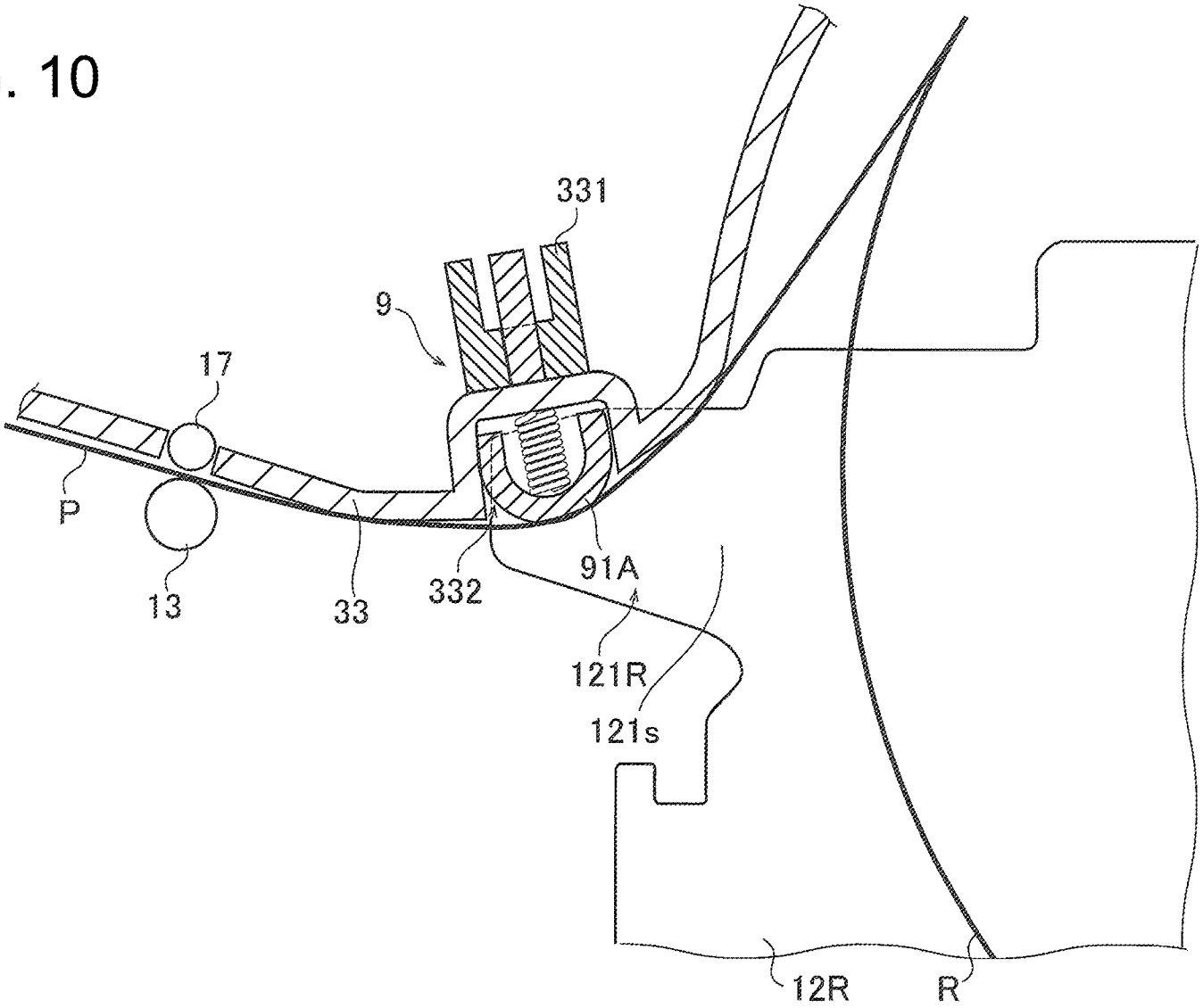
FIG. 10 is an enlarged cross-sectional view schematically showing the operation of a damper according to one embodiment.
Figure 11:
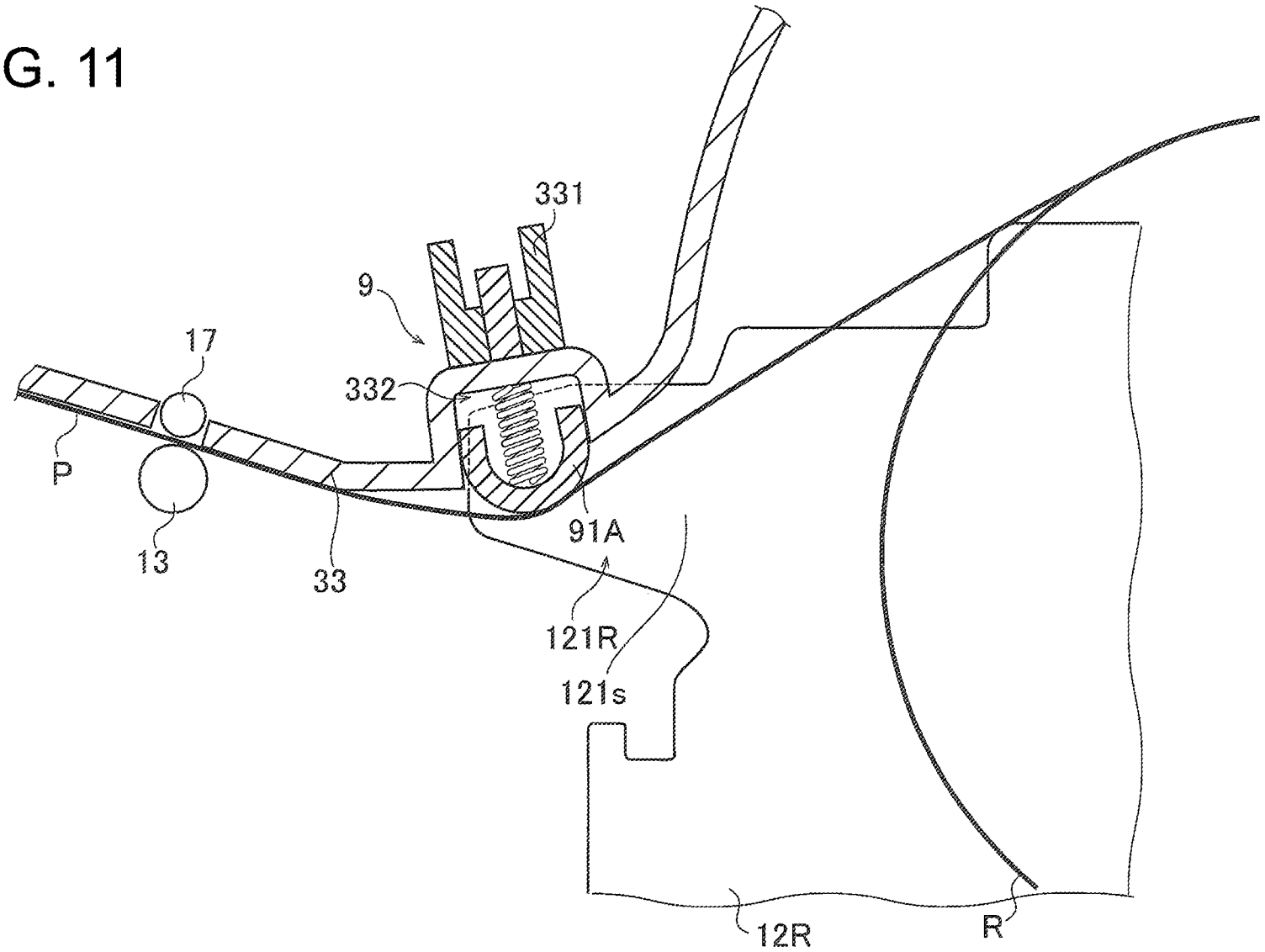
FIG. 11 is an enlarged cross-sectional view schematically showing the operation of a damper according to one embodiment.

FIG. 8A is a front view of the damper 9 according to the present embodiment. FIG. 8B is a perspective view of the damper 9 according to the present embodiment. FIG. 9 is a perspective view schematically showing the attaching of the damper 9 according to the present embodiment. FIG. 10 is an enlarged cross-sectional view schematically showing the operation of the damper 9 according to the present embodiment. FIG. 11 is an enlarged cross-sectional view schematically showing the operation of the damper 9 according to the present embodiment.

Referring firstly to FIGS. 8 and 9, the following describes the structure of the damper 9.

As shown in FIGS. 8A and 8B, the damper 9 includes a body 91 and a coil spring 92. The body 91 has an abutting part 91A to abut on the surface of the continuous sheet P, a pair of arms 91B to attach the damper 9 to the cover 3, and a guide 91C that functions as a guide for the coil spring 92 during the expansion and contraction.

The pair of arms 91B extends from the abutting part 91A along the extending direction of the coil spring 92, and has attachment claws 91Ba at the leading ends.

As shown in FIG. 9, the attachment claws 91Ba engage with a pair of attachments 331 on the rear face (i.e., the inside of the cover 3) of the inner wall 33 (see FIG. 7 as well) of the cover 3 by latching, whereby the damper 9 is attached to the cover 3. The damper 9 moves between the position where the coil spring 92 contracts to be the smallest until the lower face of the abutting part 91A of the body 91 is at the highest (uppermost) position (hereinafter called "a first position") and the position where the coil spring 92 expands to be the largest until the lower face of the abutting part 91A of the body 91 is at the lowest (lowermost) position (hereinafter called "a second position").

Referring next to FIGS. 10 and 11, the following describes the operation of the damper 9. FIG. 10 shows the operation of the damper 9 at an initial stage of the roll of paper R stored having a larger outer shape. FIG. 11 shows the operation of the damper 9 at a final stage of the roll of paper R stored having a smaller outer shape.

As shown in FIGS. 10 and 11, the abutting part 91A of the damper 9 moves between the first position and the second position in the recess 332 formed at the inner wall 33 of the cover 3.

As shown in FIG. 10, at the initial stage of the roll of paper R stored having a large outer shape, the roll of paper R is heavy. Such a heavy weight is resistance to the feeding of the sheet, and therefore a large tension is generated at the continuous sheet P extracted from the roll of paper. Such a large tension pushes the damper 9 upward against the biasing force of the coil spring 92 of the damper 9 until the abutting part 91A of the damper 9 moves to the uppermost first position in the recess 332.

On the contrary, as shown in FIG. 11, at the final stage of the roll of paper R stored having a small outer shape, the roll of paper R is lighter than the roll of paper R having a large diameter. Such a light weight is resistance to the feeding of the sheet, and therefore a relatively small tension is generated at the continuous sheet P extracted from the roll of paper. This makes the biasing force of the coil spring 92 of the damper 9 relatively larger, and so the abutting part 91A of the damper 9 moves to the lowermost second position in the recess 332. This prevents the loosing of the continuous sheet P.

As shown in FIGS. 10 and 11, the lower face of the abutting part 91A of the damper 9, which is at the first position or the second position, is located at a position opposed to the abutting face 121*s* of the paper guide 121R of the limiter 12R. Although not shown, the damper 9, which is at the first position or the second position, is located at a position opposed to the abutting face 121*s* of the paper guide 121L of the limiter 12L. With this configuration, the damper 9 allows both ends of the continuous sheet P in the width direction to be always (from the initial stage to the final stage of the roll of paper R used) guided from the both sides of the continuous sheet P in the width direction, and so can prevent the continuous sheet P from moving in the width direction of the continuous sheet P.

As described above, the printer 1 of the present embodiment includes the limiters 12L, 12R having the abutting faces 12*s* and 121*s* to limit the movement of the roll of paper R stored in the container 8 and the continuous sheet P extracted from the roll of paper R in their width directions. The damper 9 is disposed at a position opposed to the surface of the continuous sheet P extracted from the roll of paper R and the abutting face 121*s*, and the damper is to absorb fluctuations in tension of the continuous sheet P. The limiters 12L, 12R therefore function as a guide of the side face Rs of the roll of paper R and as a guide of the continuous sheet P extracted from the roll of paper R in the width direction. Therefore another guide separate from the limiters 12L, 12R is not required at the position of the damper 9. Such a printer 1 can avoid the movement of the continuous sheet in the width direction without increasing the size or the number of components.

The embodiment of the present invention has been described above in detail. The printer of the present invention is not limited to the above embodiment, and the embodiment may be modified or changed variously without departing from the scope of the present invention.

In the above embodiment, a pair of limiters 12L, 12R and a pair of roll holders 14L, 14R are provided to hold the roll of paper R from both side faces Rs, and the motion mechanism 20 acts so that the roll of paper R can be kept at the center of the printer 1 in the transverse direction. In another embodiment of the printer, the printer 1 may hold the roll of paper R on the left or the right of the printer. In this case, the limiter and the roll holder may be provided at any one of the left and the right sides.

When the roll of paper R is held on the left or the right of the printer 1, the damper 9 is mounted not at the center position of the roll of paper R in the width direction but on the same side of the roll of paper R. This allows such a single limiter mounted on the left or the right to function as a guide of the side face Rs of the roll of paper R and as a guide of the continuous sheet P extracted from the roll of paper R in the width direction.

In the above embodiment, the limiters 12L, 12R and the roll holders 14L, 14R are plate-like members, and in another embodiment, these components may have a different shape. These plate-like members, however, lead to an advantageous effect of keeping a large space for the roll of paper R in the width direction when the guide mechanism 10 is mounted at the printer 1.

In the above embodiment, the continuous sheet P including a belt-like liner PM and a plurality of labels PL that are temporally attached on the liner at predetermined intervals are illustrated as an example of the roll of paper R held by the guide mechanism 10. In another embodiment, any type of the roll of paper R may be used, which may be wound print paper not including an adhesive or may be wound print paper that is long and includes adhesive on the rear face.

In the above embodiment, the container stores the roll of paper R having a paper core RC as one example of the roll. The present invention limits the movement of the roll of paper stored in the container and the continuous sheet extracted from the roll of paper in their width directions, and the roll of paper may or may not have a paper core. For instance, the present invention is applicable to a printer configured to place a roll of paper without a paper core on the bottom face inside of the container instead of holding the roll of paper in the container.

REFERENCE SIGNS LIST

1 printer
2 housing
3 cover
31 shaft
33 inner wall
331 attachment
332 recess
4 display panel
5 platen roller
6 thermal head
7 ejection port
8 container
9 damper
91 body
91A abutting part
91B arm
91Ba attachment claw
91C guide
92 coil spring
10 guide mechanism
12L, 12R limiter
12*s*, 121*s* abutting face
121L, 121R sheet guide
122, 124 thin-wall part
14L, 14R roll holder
141 plate-like body
141*s* surface
1412, 1414 attachment
142 shaft
143 swing member
1432 holding part
144 torsion spring
15 cutter
16 lock member
161 tab
162 shaft
163 engagement part
13, 17 assisting roller
18 coil spring
20 motion mechanism
21 housing
21R rear face
211 engagement part
22L, 22R rack
220L, 220R fastener
24 pinion
R roll of paper
Rs side face of roll of paper
RC paper core
P continuous sheet
PM liner
PL label

The invention claimed is:

1. A printer, comprising:

a housing;

a cover configured to be openable and closable with respect to the housing;

a container configured to store a roll, the roll being a belt-like shaped print medium that is wound, the container being provided in the housing;

a limiter in the container, the limiter having an abutting face configured to limit movement of (1) the roll stored in the container and (2) the belt-like shaped print medium extracted from the roll in a width direction; and a damper, configured to contact the print medium, arranged at the cover, the damper being disposed at a position opposed to a surface of the print medium extracted from the roll and, the abutting face when the cover is closed.

2. The printer according to claim 1, wherein the limiter includes a first limiting portion and a second limiting portion, the first limiting portion and the second limiting portion movable toward each other or movable away from each other, and the damper is disposed at a center position between the first limiting portion and the second limiting portion in the moving direction thereof.

3. The printer according to claim 1, wherein the damper is configured to move between a first position and a second position, and the damper is opposed to the abutting face when the damper is located at the first position or at the second position.

4. The printer according to claim 1, wherein the cover is formed so as to provide a region on the outside of the damper in the width direction, the region allowing at least a part of the limiter to move.

5. The printer according to claim 1, wherein the damper has a width in the width direction, the width of the damper being smaller than the width of the print medium.

6. The printer according to claim 1, further comprising a thermal head configured to print on the print medium, the thermal head being mounted at the cover.

7. The printer according to claim 6, further comprising a biasing member configured to bias the thermal head.

8. The printer according to claim 1, wherein the limiter includes a flutter prevention part configured to prevent the belt-like shaped print medium from fluttering in the direction of the faces of the print medium that is drawn from the roll.

9. The printer according to claim 1, wherein a lower face of the damper is configured to abut the belt-like shaped print medium.

10. The printer according to claim 1, wherein the cover is configured to open and close the container.

11. The printer according to claim 1, wherein from a side view at least a part of the damper overlaps the abutting face.

12. The printer according to claim 1, wherein the limiter comprises two abutting faces configured to limit movement of the print medium and at least a part of the damper is between the two abutting faces when the cover is closed.

13. A printer, comprising:

a housing;

a cover configured to be openable and closable with respect to the housing;

a container configured to store a roll, the roll being a belt-like shaped print medium that is wound, the container being provided in the housing;

a limiter in the container, the limiter having an abutting face configured to limit movement of (1) the roll stored in the container and (2) the belt-like shaped print medium extracted from the roll in a width direction; and a damper arranged at the cover, the damper being disposed at a position opposed to a surface of the print medium extracted from the roll and the abutting face when the cover is closed;

wherein the limiter includes a first limiting portion and a second limiting portion, the first limiting portion and the second limiting portion movable toward each other or movable away from each other, and the damper is disposed at a center position between the first limiting portion and the second limiting portion in the moving direction thereof.

* * * * *